United States Patent [19]

Bruser et al.

[11] Patent Number: 4,688,969

[45] Date of Patent: Aug. 25, 1987

[54] ELECTRICAL GROUND ROD INSTALLATION DEVICE

[75] Inventors: Lewis Bruser; Alfred G. Swap, both of Bremerton, Wash.

[73] Assignee: Puget Sound Power and Light Company, Bellevue, Wash.

[21] Appl. No.: 847,540

[22] Filed: Apr. 2, 1986

[51] Int. Cl.[4] ..... H01R 4/66; E02D 5/80

[52] U.S. Cl. ..... 405/303; 174/7; 52/157; 52/165; 405/232; 405/243

[58] Field of Search ..... 405/239, 240, 241, 242, 405/243, 303, 258, 232; 52/165, 157; 174/7, 6

[56] References Cited

U.S. PATENT DOCUMENTS

| | | | |
|---|---|---|---|
| 2,207,134 | 7/1940 | Staples | 52/165 X |
| 3,293,809 | 12/1966 | Daline | 52/157 |
| 3,318,560 | 5/1967 | Garrette et al. | 52/165 X |
| 3,464,216 | 9/1969 | Turzillo | 405/239 |
| 3,512,366 | 5/1970 | Turzillo | 405/239 X |
| 3,830,315 | 8/1974 | Love | 52/157 X |
| 4,014,144 | 3/1977 | Gale | 52/157 |
| 4,040,260 | 8/1977 | Pryke | 405/239 |
| 4,334,392 | 6/1982 | Dziedzic | 52/157 |
| 4,467,575 | 8/1984 | Dziedzic | 52/157 |

*Primary Examiner*—Dennis L. Taylor
*Attorney, Agent, or Firm*—Seed and Berry

[57] ABSTRACT

A ground rod installation device having an auger fixedly mounted on the lower end of an elongated drive shaft. A pilot drill projects downwardly from the lower end of the auger. The shaft, auger, and pilot drill have aligned axial passages into which the ground rod is inserted. A releasable fastener then secures the ground rod in place inside the shaft. The shaft is rotated in one direction, thereby causing the auger to draw the shaft into the ground. After the releasable fastener has released the ground rod from the shaft, the shaft is rotated in the opposite direction, thereby withdrawing the shaft from the ground while allowing the ground rod to fall through the passages in the auger and pilot drill and remain in the ground.

13 Claims, 3 Drawing Figures

ELECTRICAL GROUND ROD INSTALLATION DEVICE

TECHNICAL FIELD

This invention relates to electrical ground rods, and more particularly, to a ground rod installation device that allows relatively inexpensive ground rods to be quickly and easily installed even in hard-packed ground.

BACKGROUND ART

The transfer of electricity from power stations to substations and homes is done using transformers, power lines, cables, and other equipment. Grounding rods are set into the earth and connected into the network at various locations for safety purposes. Ground rods are often installed by driving them into the ground with a hammer or hydraulic ram. While the technique is often satisfactory for very loosely packed or soft ground, it is not satisfactory for many ground conditions, particularly since the rod is usuallly driven into the ground to a depth of eight feet or more. Often, the ground rod becomes bent during the installation process and is then driven at an angle to a relatively shallow depth rather than vertically to a depth that would provide better grounding.

Another method of setting the ground rod into the earth is to use an auger to drill a hole. After removing the auger, the ground rod is set in place and earth is repacked around it. This installation method has a couple of disadvantages. First, drilling the hole and then repacking it take a relatively large amount of time, thus making installation of ground rods by this method quite expensive. Second, for adequate grounding, the ground rod should be placed in undisturbed earth so that the earth tightly surrounds the rod. When the rod is placed in a hole and repacked with earth, the earth may not make sufficient contact with the rod to provide optimum grounding.

Another method in commercial use uses a ground rod in which an auger is fixedly mounted on the lower end of the rod. The ground rod is installed by placing it into a hollow shaft having threads at its lower end that are screwed onto the auger. Rotation of the shaft drives the ground rod into the earth, since the auger mounted at the lower end of the rod advances the rod downward into the earth. By rotating the hollow shaft coaxially in the opposite direction, the hollow shaft unscrews from the head of the ground rod and is drawn out of the ground for reuse. The principal disadvantage of using ground rods having permanently mounted auger heads is the relatively high cost of such ground rods.

DISCLOSURE OF THE INVENTION

It is an object of this invention to provide an improved technique for easily installing conventional cylindrical shaft ground rod designs.

It is another object of the invention to provide an improved technique for easily installing conventional ground rods using conventional equipment found on most electric utility line trucks.

It is a further object of the invention to provide a relatively inexpensive technique for easily and quickly installing conventional ground rods with good electrical contact with the surrounding earth.

An improved ground rod installation device installs standard cylindrical ground rods by supporting a ground rod within as the device advances into the earth, then releasing the rod to slide freely through the forward end of the device as the device is retracted, enabling the entire installation device to be retrieved and reused. By incorporating the pilot drill and helical band windings into the sleeve element and extending the passage through the sleeve to include the pilot drill, no part of the installation means need be attached to the ground rod and the ground rod can be released to slide through the sleeve as the device is retracted. This improved structure combines the features of providing support to the ground rod during installation, minimizing the diameter of the hole in the earth containing the ground rod, and retrieving the entire installation device for reuse.

BEST MODE FOR CARRYING OUT THE INVENTION

Figure 1:
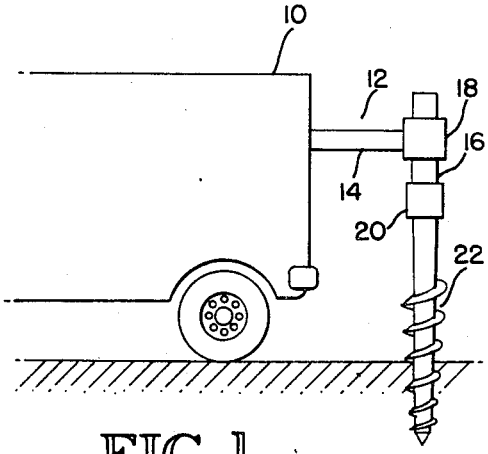
FIG. 1 is an isometric view showing a conventional electric utility line truck having a hydraulic drive unit that can utilize the inventive ground rod installation device.

A conventional electric utility line truck 10, as illustrated in FIG. 1, typically includes a rear-mounted hydraulic power unit 12. Briefly, the power unit 12 is mounted at the end of a horizontal boom 14, and it includes a vertical drive shaft 16 mounted in a hydraulic motor 18. The shaft 16 can be of a variety of configurations, but it is preferably in the configuration of a polygon, such as a square, hexagonal, or octagon shape. Utilizing a drive shaft 16 having a polygon configuration, rather than tubular, allows the lower end of the shaft 16 to be "keyed" into a conventional coupler 20 so that the coupler 20 does not have to tightly grip the shaft 16 in order to transmit torque from the shaft 16. Although a variety of tools may be secured to the coupler 20, an auger 22 is most commonly mounted on the coupler 20. Rotation of the shaft 16, referred to in the art as a Kelly bar, by the hydraulic motor 18 rotates the auger 22 through coupling 20, thereby causing the auger 22 to dig a vertical hole in the ground for the receipt of telephone poles. Conventional means (not shown) are provided to cause the kelly bar 16 to move axially to lift the auger 22 from the hole after it has been dug.

The inventive ground rod installation device is specifically adapted for use with power units 12 of the type described above since they are in most common use. However, it will be understood that the installation device, as described below, can be used with other types of power-drive mechanisms.

Figure 2:
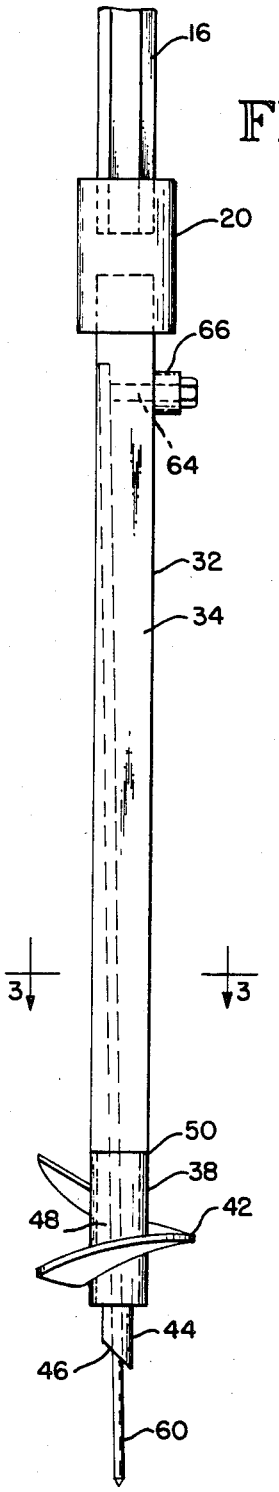
FIG. 2 is an elevational view of a preferred embodiment of the ground rod installation device.
Figure 3:
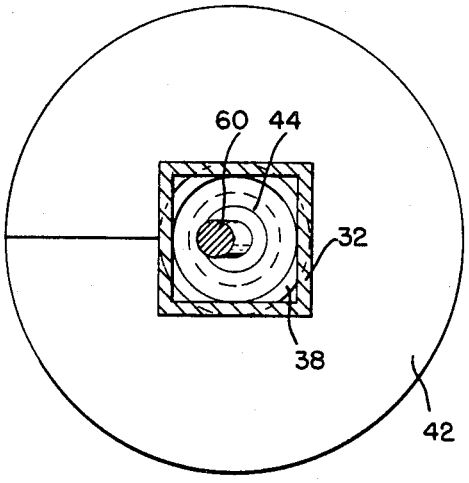
FIG. 3 is a cross-sectional view of the ground rod installation device taken along the line 3—3 of FIG. 2.

With reference now to FIG. 2, the inventive ground rod installation device 30 includes a shaft 32 having a hollow center passage 34. The shaft 32 is of substantially the same design as the shaft utilized to drive conventional ground rods having an auger permanently mounted at their lower ends. The shaft 32 may, like the Kelly bar 16, have a variety of cross-sectional configurations, but a polygon configuration is preferred since it allows the upper end of the shaft 32 to be keyed to a like recess in the coupler 20. In contrast, tubular shafts 32 require that the coupler 20 tightly grip the shaft 32 in order to couple torque to the shaft 32. Such frictional joints can sometimes slip and they may loosen when, for example, they are subjected to vibrations or variations in temperature.

An auger 38 of conventional design is fixedly mounted at the lower end of the shaft 32. The auger 38 includes a cylindrical body 40 having a helical screw 42 extending around and along its periphery. A cylindrical pilot drill 44 having an inclined end 46 projects downwardly from the lower end of the cylindrical body 40.

The auger 38 may be manufactured from the augers that are fixedly mounted on the lower ends of conventional screw anchors. Under these circumstances, a bore 48 must be formed in the cylindrical body 40 and pilot drill 44, and the cylindrical body 40 must be welded to the shaft 32 at 50. The screw anchors are installed in a manner similar to the manner in which ground rods having fixedly mounted augers are installed, as described above. The auger 38 is advanced into the ground by rotation of the shaft 32. When the auger has reached sufficient depth, the shaft 32 is rotated in the opposite direction, thereby unthreading the shaft 32 from the auger 38. The shaft 32 is then pulled out of the ground, leaving the auger 38 and upwardly projecting ground rod (not shown) in the ground. As explained in greater detail below, in the inventive device the auger 38 is removed from the ground along with the shaft 32, thus requiring the weld bead 50 to prevent the auger 38 from being unthreaded from the shaft 32. A conventional ground rod 60 is positioned in the hollow passage 34 of the shaft 32 and the bore 48 of the cylindrical body 40 and pilot drill 44, with its lower end projecting downwardly from the inclined end 46 of the pilot drill 44. The ground rod 60 is secured in position by a bolt 64. The bolt 64 is threaded through a nut 66 that is fixedly mounted on the outside of the shaft 32. The bolt 64 thus forces the ground rod 60 against the inside surface of the passage 34, thereby frictionally locking the ground rod 60 to the shaft 32.

In operation, the ground rod 60 is initially placed in the shaft 32, as shown in FIG. 2. It will be understood, however, that the length of the ground rod 60 projecting from the pilot drill 44 may be adjusted, depending upon, for example, such factors as the hardness of the earth or the presence of rocks and other obstructions which generally require a shorter length of projecting ground rod 60. The bolt 64 is then tightened in nut 66 to frictionally secure the ground rod 60 to the shaft 32. Either before or after the ground rod 60 is placed in the shaft 32, the shaft 32 is mounted in the coupler 20. The lower end of the ground rod 60 (or pilot drill 44, if the ground rod 60 is not projecting from the lower end of the pilot drill 44) is then placed against the ground, and the shaft 32 is rotated in a clockwise direction. Rotation of the shaft 32 in a clockwise direction causes the helical screw 42 of the auger 38 to pull the auger 38 into the ground through a combination of screwing action and digging. When the ground rod has reached sufficient depth, the bolt 64 is rotated in a counterclockwise direction, thereby releasing the ground rod 60 from the shaft 32. The shaft is then rotated in the opposite direction (i.e., counterclockwise), thereby causing the auger 38 to be pulled upwardly out of the ground. If desired, an upward axial force may also be applied to the shaft 32 to assist in the removal of the auger 38 from the ground. Since the ground rod 60 has been released from the shaft 32, the ground rod 60 is left in the ground when the shaft 32 and auger 38 are removed from the ground, as described above. It is thus seen that the installation device can quickly and easily install conventional, relatively inexpensive ground rods in a manner that provides good electrical contact with the surrounding earth.

While the preferred embodiment of this invention has been shown and described, those skilled in the art will understand that numerous modifications may be made without departing from the scope of this invention. Therefore, this invention should not be limited to the preferred embodiment unless limitation is necessary in light of either the prior art or the scope and nature of the appended claims.

We claim:

1. An improved device for installing electrical ground rods, comprising:

a rigid elongated shaft having a central passage through its longitudinal axis adapted to slidably receive said ground rod;

a screw auger fixedly mounted at the lower end of said shaft, said auger having a central passage through its longitudinal axis that is aligned with the central passage of said shaft so that said ground rod may project from the central passage of said shaft through the central passage of said auger; and fastening means for releasably securing said ground rod within at least one of said central passages, whereby rotating of said shaft in one direction causes said installation device to be drawn into the ground, while rotation of said shaft in the opposite direction, after said ground rod has been released by said fastening means, causes said installation device to be drawn out of the ground, leaving only said ground rod in the ground.

2. The improved ground rod installation device of claim 1 wherein the cross section of the rigid elongated shaft is square.

3. The improved ground rod installation device of claim 1 wherein a pilot drill projects downwardly from the lower end of said auger, said pilot drill having a through-bore aligned with the central passage of said auger to allow said ground rod to pass through said pilot drill when said ground rod is released by said fastening means.

4. The improved ground rod installation device of claim 1 wherein said fastening means includes a nut mounted on said shaft and a bolt threaded through said nut and extending into the central passage of said shaft to force said ground rod against the sides of said central passage.

5. An improved system for installing electrical ground rods, comprising:

a hollow elongated shaft;

a rotary drive unit engaging said shaft and selectively rotating said shaft in either direction; and a screw auger fixedly mounted on one end of said shaft for insertion into and removal from the ground with the shaft, said auger having a through-bore that is aligned with the hollow axis of said shaft, whereby a ground rod inserted in the hollow axis of said shaft may be installed in the ground by selectively causing said rotary drive unit to rotate said shaft in one direction in order to drive said auger into the ground and then selectively causing said rotary drive unit to rotate said shaft in the opposite direction in order to withdraw said auger from the ground and allow said ground rod to fall through said through-bore of said housing and remain in the ground.

6. The system of claim 5, further including a releasable fastener releasably securing said ground rod-in the hollow axis of said shaft in order to prevent said ground rod from falling through the through-bore of said auger until said fastener has released said ground rod.

7. The system of claim 6 wherein said releasable fastener includes a nut mounted on said shaft and a bolt threaded through said nut and extending into the hollow axis of said shaft to force said ground rod against the inside walls of said shaft.

8. The system of claim 5 wherein said rotary drive unit comprises a bar and a hydraulic motor selectively rotating said bar in opposite directions.

9. The system of claim 8, further including a collar connecting the lower end of said bar to the upper end of said shaft, said collar having a cylindrical configuration with two opposed axial recesses receiving the ends of said bar and shaft, respectively.

10. The system of claim 9 wherein said bar, shaft and recesses all have a cross-sectional polygon configuration, with the configuration of the recess receiving said bar matching the configuration of said bar and the configuration of the recess receiving said shaft matching the configuration of said shaft in order to couple torque from said bar to said shaft.

11. The system of claim 5, further including a pilot drill projecting downwardly from the lower end of said auger, said pilot drill having a through-bore aligned with the through-bore of said auger to allow said ground rod to pass through said pilot drill when said ground rod is released by said fastener.

12. A method of installing ground rods, comprising:

placing said ground rod in a central bore in an elongated rigid shaft and in an auger fixedly secured to one end of said shaft;

placing said auger against the ground and rotating said shaft in one direction, thereby causing said auger to draw said shaft into the ground; and rotating said shaft in the opposite direction while allowing said ground rod to fall downwardly through the central bore in said auger, whereby said shaft and auger are withdrawn from the ground, leaving only said ground rod embedded in the ground.

13. The method of claim 12, further including the step of securing said ground rod to said shaft until said auger has been rotated to substantially its maximum depth.

* * * * *